United States Patent [19]

Haginomori

[11] 4,419,552

[45] Dec. 6, 1983

[54] CIRCUIT BREAKER

[75] Inventor: Eiichi Haginomori, Tokyo, Japan

[73] Assignee: Tokyo Shibaura Denki Kabushiki Kaisha, Kawasaki, Japan

[21] Appl. No.: 227,252

[22] Filed: Jan. 22, 1981

[30] Foreign Application Priority Data

Apr. 25, 1980 [JP] Japan ..... 55-55023

[51] Int. Cl.[3] ..... H01H 33/16

[52] U.S. Cl. ..... 200/144 AP

[58] Field of Search ..... 200/144 AP

[56] References Cited

U.S. PATENT DOCUMENTS 3,538,278 11/1970 Rathbun ..... 200/144 AP
4,072,836 2/1978 Bischofberger et al. .... 200/144 AP

FOREIGN PATENT DOCUMENTS 346301 12/1921 Fed. Rep. of Germany ..... 200/144 AP
762014 2/1954 Fed. Rep. of Germany ..... 200/144 AP
2827482 1/1980 Fed. Rep. of Germany ..... 200/144 AP
49-21508 6/1974 Japan .
49-28545 7/1974 Japan .
51-93367 8/1976 Japan .

*Primary Examiner*—Robert S. Macon
*Attorney, Agent, or Firm*—Oblon, Fisher, Spivak, McClelland & Maier

[57] ABSTRACT

A circuit breaker device is disclosed which includes a main contact coupled in parallel with a series combination of a resistor and a resistor contact. The wipe length of the resistor contact is longer than that of the main contact. Means are provided for moving both contacts simultaneously at the same rate in the closing direction such that the main contact closes prior to the closing of the resistor contact. Means are provided for moving the contacts in the opening direction such that the resistor contact moves at a slower rate than the main contact whereby the main contact is opened prior to the resistor contact.

8 Claims, 5 Drawing Figures

CIRCUIT BREAKER

BACKGROUND OF THE INVENTION

1. Field of the Invention

This invention relates, in general, to circuit breakers, and more particularly to circuit breakers having a resistor in parallel with a contact thereof.

2. Description of the Prior Art

Recently a circuit breaker for ultra-high voltage use, for example 500 KV use, having a resistor in parallel with a contact thereof has been used. This circuit breaker is able to suppress an overvoltage generated in the electric power system when the contact is closed by inserting the resistor in parallel with the contact for a short time such as, for example about 10 milliseconds (hereinafter abbreviated as ms) before its closing. However for a circuit breaker for higher voltage use, such as 1000 KV use, it is necessary to suppress an overvoltage generated in the electric power system not only when the contact of the circuit breaker is closed but also when it is opened.

A circuit breaker, such as a compressed air circuit breaker, is known in which a resistor is provided in parallel with a main contact in order not to suppress an overvoltage but to be broken easily. In this circuit breaker, there are provided two separate driving devices: one for use by a main contact and one for use by a resistor contact. However, it is very difficult from an economic standpoint to provide two separate driving devices which need very high power for operation and two separate coupling devices for coupling the main contact or the resistor contact with the driving devices in a circuit breaker for use at ultra-high voltages.

SUMMARY OF THE INVENTION

Accordingly, one object of this invention is to provide a novel circuit breaker which can suppress an overvoltage generated in the electric power system when it is opened or closed with a simple structure.

Another object of this invention is to provide a novel circuit breaker which can suppress an overvoltage generated in the electric power system when it is opened or closed with only one driving device.

Still another object of this invention is to provide a novel circuit breaker which can suppress an overvoltage generated in the electric power system when it is opened or closed and which can be embodied in a single pressure-type gas circuit breaker.

These and other objects of this invention are achieved by a circuit breaker which includes a main contact having a moving part and a fixed part. A series circuit, including a resistor coupled in series with a resistor contact, is coupled in parallel with the main contact. The resistor contact includes a fixed part and a moving part and has a longer wipe length than that of the main contact. The circuit breaker further includes a means for moving the moving part of the main contact to switch the contact, a means for closing the resistor contact, and a means for opening the resistor contact. The means for closing the resistor contact moves the moving part of the resistor contact together with the moving part of the main contact in the closing direction. The means for opening the resistor contact moves the moving part of the resistor contact in the opening direction independently of the moving part of the main contact. The moving speed of the moving part of the resistor contact in the opening direction is less than the moving speed of the moving part of the main contact in the opening direction.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings wherein:

FIG. 1(*b*) is a diagram illustrating the time sequence of the switching operation of the preferred embodiment of the present invention shown in FIG. 1(*a*);

FIG. 1(*c*) is a curve illustrating the relationship between contact travel and time for the preferred embodiment of the circuit breaker of the present invention shown in FIG. 1(*a*);

DESCRIPTION OF THE PREFERRED EMBODIMENTS

Figure 1A:
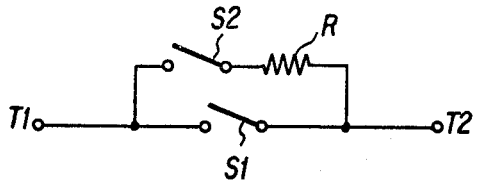
FIG. 1(*a*) is a circuit diagram of a circuit breaker according to a preferred embodiment of the present invention.
Figure 1B:
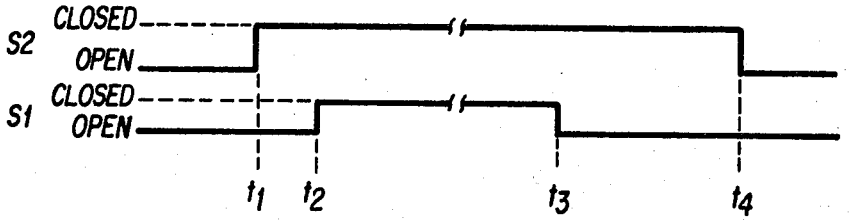
Figure 1C:
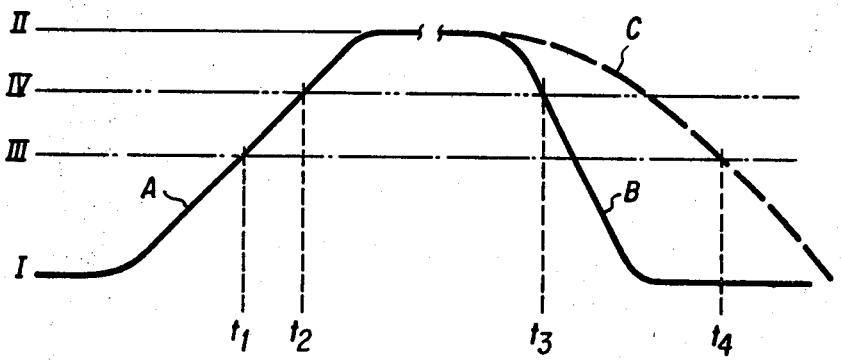

Referring now to the drawings, wherein like reference numerals designate identical or corresponding parts throughout the several views, and more particularly to FIG. 1(*a*) thereof, wherein a circuit diagram of a circuit breaker according to a preferred embodiment of this invention is shown, S1 is a main contact of the circuit breaker. T1 and T2 are terminals provided at both terminals of the main contact S1 for connecting the circuit breaker to a power circuit. A resistor R and a resistor contact S2 are connected in series with each other to form a series circuit which is connected in parallel with the main contact S1.

FIG. 1(*b*) shows the time sequence of the switching operation of the circuit breaker shown in FIG. 1(*a*). In FIG. 1(*b*), when the circuit breaker is to be closed the resistor contact S2 is closed at a time t1, and the main contact S1 is closed at a time t2 which is about 10 ms after the time t1. In the case of breaking, the main contact S1 is opened at a time t3. Since arcing generally continues for approximately 1 to 20 ms after the time t3 until the current is completely broken, the resistor contact S2 is opened at a time t4 at least 10 ms after the current is broken.

FIG. 1(*c*) illustrates a characteristic curve between travel and time of the main contact S1 and the resistor contact S2. In FIG. 1(*c*) the solid curve A shows a closing characteristic of the main contact S1 and the resistor contact S2, the solid curve B shows an opening characteristic of the main contact S1, and the broken curve C shows an opening characteristic of the resistor contact S2. Moreover I shows a final tripped position of both the main contact S1 and the resistor contact S2, II shows a final closed position of both the main contact S1 and the resistor contact S2, III shows a closing position of the resistor contact S2, and IV shows a closing position of the main contact S1. The distance between the position III and the position II illustrates a wipe length of the resistor contact S2 and the distance between the position IV and the position II shows a wipe length of the main contact S1. Therefore the wipe length of the resistor contact S2 is longer than that of the main contact S1.

In the case of closing, both the main contact S1 and the resistor contact S2 move along the curve A from the position I. At the time t1 the curve A reaches the position III, where the resistor contact S2 is closed. Then the curve A reaches the position IV at the time t2, 10 ms after the time t1, where the main contact S1 is closed. Finally the curve A reaches the position II where both the main contact S1 and the resistor contact S2 remain closed. In the case of breaking, both the main contact S1 and the resistor contact S2 start to move at the same time. The main contact S1 moves along the curve B and the curve B reaches the position IV at the time t3 where the main contact S1 is opened. The resistor contact S2 moves along the curve C at a slower speed than that of the curve B, and the curve C reaches the position III at the time t4, 30 ms after the time t3, where the resistance contact S2 is opened. Finally the curve B and the curve C reach the position I where both the main contact S1 and the resistor contact S2 remain open.

Figure 2:
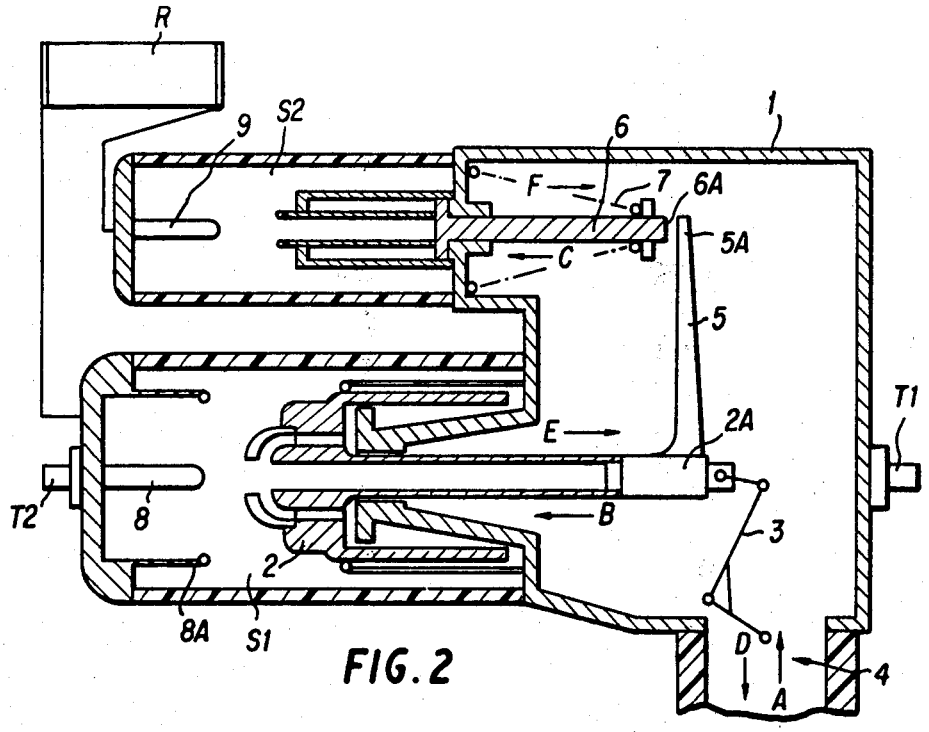
FIG. 2 is an elevational view in section of the circuit breaker of the present invention shown in FIG. 1(*a*)

FIG. 2 illustrates an example of a structure of a circuit breaker according to a first preferred embodiment of the present invention in its open state, which has the operating characteristic described above. In FIG. 2, there are provided a casing 1, moving parts 2, 6, and fixed parts 8, 9 in the main contact S1 and the resistor contact S2 respectively. The moving part 2 and the fixed part 8 of the main contact S1 are positioned in parallel with the moving part 6 and the fixed part 9 of the resistor contact S2, respectively. Each of the moving parts 2, 6 is provided so that it can be advanced or retracted freely in the same direction. The fixed parts 8, 9 are provided at the advance direction of the moving parts 2, 6 which contact the fixed parts 8, 9 with the contact portions of the moving parts 2, 6, respectively, as is apparent to those skilled in the art. The fixed part 8 is connected electrically to the terminal T2 and the fixed part 9 is connected electrically to the terminal T2 through the resistor R. Both the moving parts 2, 6 are connected electrically to the terminal T1. There is also provided a main electrode 8A connected to the fixed part 8 of the main contact S1. The moving part 2 of the main contact S1 is connected to a driving means (not shown) through a lever 3, as is apparent to those skilled in the art. There is also provided a lever 5 fixed on the end portion 2A of the moving part 2 of the main contact S1. An end portion 5A of the lever 5 is positioned so that it touches an end portion 6A of the moving part 6 of the resistor contact S2 when the moving part 2 is moved to close the main contact S1. Thus the moving part 6 is moved together with the moving part 2 by maintaining contact between the end portion 5A of the lever 5 and the end portion 6A of the moving part 6. There is provided a spring member 7 to supply a biased elastic force to the moving part 6 in the rightward direction as shown in FIG. 2.

In the circuit breaker of FIG. 2, the travel distance between the contact portions of the moving part 2 and the fixed part 8 in the main contact S1 is 50 mm longer than the travel distance between the contact portions of the moving part 6 and the fixed part 9 in the resistor contact S2. Thus the distance between the position III and the position IV in FIG. 1(*c*) corresponds to 50 mm. Next, the wipe length of the main contact S1 is 50 mm which means that the distance between the position IV and the position II in FIG. 1(*c*) corresponds to 50 mm. The wipe length of the resistor contact S2 is 50 mm longer than that of the main contact S1, namely 100 mm, which means that the distance between the position III and the position II in FIG. 1(*c*) corresponds to 100 mm.

The characteristics of the driving means (not shown) and the spring member 7 will now be described. In the case of closing, both the moving parts 2, 6 are driven by the driving means (not shown) at a driving speed of 5 m/s. On the other hand, in the case of breaking, the moving part 2 of the main contact S1 is driven momentally by the force generated in the driving means (not shown), for example by means of hydraulic or pneumatic pressure, at an acceleration of about 1000 $m/s^2$. The moving part 6 of the resistor contact S2 is driven by the elastic force of the spring member 7 at an acceleration of about 125 $m/s^2$.

The resistance value of the resistor R is 500 ohms. This resistance value is determined by an analysis of the switching phenomena in an electric power system. According to the analysis, it is clear that a switching overvoltage can be suppressed to a safe value by inserting a resistor in parallel with a main contact of a circuit breaker for use with ultra-high voltage. For example, in the case of a 1000 kv circuit breaker, the resistance value of the parallel resistor has been determined to be 500 ohms.

The portion of the circuit breaker shown in FIG. 2 may be contained in a ground tank filled with $SF_6$ gas having a pressure of 0.5 to 0.7 megapascal. Alternatively, only a part of the main contact S1 and the resistance contact S2 may be contained in an insulator filled with $SF_6$ gas.

The operation of the circuit breaker described above will now be explained. First, in the case of closing, an upward force (shown as an arrow A at the position 4) is applied to the lever 3 by the driving means (not shown) to drive the moving part 2 leftward (shown as an arrow B). As the lever 5 moves leftward with the moving part 2, the end portion 5A of the lever 5 touches the moving part 6 of the resistor contact S2 at the portion 6A and the moving part 6 is also driven leftward (shown as an arrow C) together with the moving part 2 at a simultaneous speed of 5 m/s. After the moving part 2 and the moving part 6 begin moving, the moving part 6 contacts the fixed part 9 at the time t1. Then the moving part 2 contacts the fixed part 8 at the time t2. The interval between the time t2 and the time t1 is 10 ms, because the driving speed of the moving part 2 is 5 m/s and the difference between the travel distance of the main contact S1 and the resistor contact S2 is 50 mm. Finally, the main electrode 8A contacts the moving part 2 to aid in the conduction of the current flowing through the main contact S1. Thus, the circuit breaker meets the necessary characteristics shown in FIG. 1(*c*) for the case of closing.

For the case of opening, a downward force (shown as an arrow D at the position 4) is applied to the lever 3 by the driving means (not shown) to drive the moving part 2 rightward (shown as an arrow E). As the lever 5 is moved rightward along with the moving part 2, it becomes separated from the moving part 6. The moving part 6 is driven rightward (shown as an arrow F) by the elastic force of the spring member 7. Here the moving part 2 of the main contact S1 is driven momentally with an acceleration of approximately 1000 $m/s^2$ by the driving means (not shown) and the main contact S1 is opened at the time t3 shown in FIG. 1(*c*) which is 10 ms after the beginning of the breaking operation. On the other hand, the resistor contact S2 starts its breaking operation at the same time; however, the moving part 6 of the resistor contact S2 is driven with an acceleration of approximately 125 m/s$^2$ due to the elastic force of the spring member 7 which is independent of the main contact operation. Then the resistor contact S2 is opened at the time t4 shown in FIG. 1(*c*) which is 40 ms after the beginning of the breaking operation. Therefore the resistor contact S2 is opened at the time t4 which is 30 ms after the time t3 when the main contact S1 is opened as shown in FIG. 1(*c*). Thus the circuit breaker meets the necessary characteristics shown in FIG. 1(*c*) for the case of breaking.

The present invention is not restricted to the embodiment described above. For example, the circuit breaker shown in FIG. 2 may be constructed such that gas flow is generated around the contact portions of the fixed part 9 and the moving part 6 of the resistor contact S2 at the time of the breaking operation to improve the breaking characteristics of the resistor contact S2. In this case, the velocity of the moving part 6 at the time t4 when the resistor contact S2 is opened is 5 m/s which is fast enough to interrupt the current flowing through the resistor contact S2.

Figure 3:
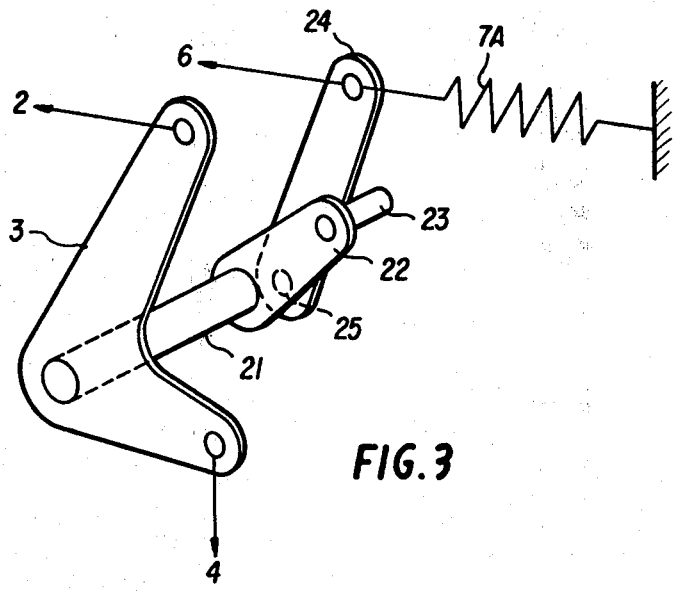
FIG. 3 is a partial perspective view illustrating an essential part of a circuit breaker according to another embodiment of this invention.

FIG. 3 shows an essential part of a circuit breaker according to another embodiment of this invention. The structure of the other parts of this circuit breaker, which are not shown in FIG. 3, are the same as those of the circuit breaker shown in FIG. 2 except that the lever 5 and the spring member 7 are not included in this circuit breaker. Common portions of the circuit breakers of FIGS. 2 and 3 are assigned the same reference numbers. In FIG. 3, the lever 3 is fixed to an end portion of a shaft 21. One end portion of the lever 3 is connected to the moving part 2 of the main contact S1 and the other end portion of the lever 3 is connected to the driving means (not shown) so that the moving part 2 can be advanced or retracted as shown in FIG. 2. A second lever 22, includes a first end fixedly attached to the other end of the shaft 21 and a second end which is provided with a pin 23. A lever 24, utilized in conjunction with the resistor contact S2 is positioned on the path of rotation of the pin 23 and rotates freely around a supporting point 25. The end portion of the lever 24 is connected to the moving part 6 of the resistor contact S2 and is also connected to a spring member 7A. The spring member 7A supplies a biased elastic force which produces an acceleration of 125 m/s$^2$ to the moving part 6 in the breaking direction (righthand direction). The lever 22 and the lever 3 are fixedly attached to shaft 21 with a given angular displacement with respect to each other such that when shaft 21 is rotated in a counterclockwise direction, lever 22 and pin 23 cooperate with lever 24 to close resistor contact S2 prior to the closing of main contact S1.

For the circuit breaker constructed as described above in FIG. 3, in the case of closing the resistance contact S2 is closed 10 ms before the main contact S1 is closed. In the case of breaking, the resistance contact S2 is opened 30 ms after the main contact is opened due to the action of the spring 7A. Therefore this circuit breaker meets the necessary characteristics shown in FIG. 1(*c*) in both the cases of closing and breaking, and can suppress the overvoltage due to the switching operation thereof.

Obviously, numerous additional modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A circuit breaker comprising:
   - a main contact having a moving part and a fixed part;
   - a series circuit coupled in parallel with said main contact, said series circuit including a resistor coupled in series with a resistor contact, said resistor contact having a moving part and a fixed part;
   - means for moving said moving part of said main contact to switch said main contact;
   - means for closing said resistor contact and for moving said moving part of said resistor contact together with said moving part of said main contact in a closing direction; and
   - means for opening said resistor contact and for moving said moving part of said resistor contact independently of said moving part of said main contact in an opening direction;
   - wherein the moving speed of said moving part of said resistor contact in the opening direction due to said opening means is slower than the moving speed of said moving part of said main contact due to said moving means and wherein the initiation of said moving part of said resistor contact in the opening direction occurs simultaneously with the initiation of said moving part of said main contact in the opening direction.

2. The circuit breaker as recited in claim 1, wherein:
   - said main contact includes a first wipe length; and
   - said resistor contact includes a second wipe length, said second wipe length being longer than said first wipe length.

3. The circuit breaker as recited in claim 2, wherein said opening means comprises:
   - a spring member coupled between said moving part of said resistor contact and a stationary portion of said circuit breaker, said spring member supplying an elastic force to move said moving part of said resistor contact in said opening direction.

4. The circuit breaker as recited in claim 2 or claim 3, wherein:
   - said main contact is positioned in parallel with said resistor contact; and
   - said closing means comprises a lever coupled to said moving part of said main contact, said lever contacting said moving part of said resistor contact, said lever moving said moving part of said resistor contact together with said moving part of said main contact in said closing direction.

5. The circuit breaker as recited in claim 2 or claim 3, wherein:
   - said moving means includes a first lever coupled to said moving part of said main contact, said first lever rotating to switch said main contact; and
   - said closing means includes a second lever coupled to said moving part of said resistor contact, said second lever contacting a portion of said first lever and moving rotatably therewith in said closing direction, said second lever moving said moving part of said resistor contact together with said moving part of said main contact in said closing direction.

6. The circuit breaker as recited in claim 4, wherein: said circuit breaker is a single pressure-type gas circuit breaker.

7. The circuit breaker as recited in claim 5, wherein: said circuit breaker is a single pressure-type gas circuit breaker.

8. The circuit breaker as recited in claim 2, wherein: said second wipe length of said resistor contact is 50 mm longer than said first wipe length of said main contact.

* * * * *